United States Patent [19]

Buckner

[11] Patent Number: 5,068,840

[45] Date of Patent: Nov. 26, 1991

[54] PILOT'S WRIST MOUNT FOR CARRYING A TIMPEPIECE OR THE LIKE VERTICALLY ON THE RADIAL ASPECT OF THE WRIST

[76] Inventor: John H. Buckner, 3590 E. Imperial Hwy., Lynwood, Calif. 90262

[21] Appl. No.: 419,118

[22] Filed: Oct. 10, 1989

[51] Int. Cl.[5] ..... A44C 5/00; G04B 37/00

[52] U.S. Cl. ..... 368/281; 368/286; 224/171

[58] Field of Search ..... 368/281–282, 368/283, 286; 224/165, 170, 171

[56] References Cited

U.S. PATENT DOCUMENTS

| | | | |
|---|---|---|---|
| 2,226,138 | 12/1940 | Prestinari | 568/282 |
| 2,562,607 | 7/1951 | Ford | 368/286 |
| 2,590,572 | 3/1952 | Rasmussen | 368/282 |
| 2,745,580 | 5/1956 | Ward | 368/282 |
| 3,149,452 | 9/1964 | Smith | 368/286 |
| 3,375,958 | 4/1968 | Cooper | 368/282 |
| 4,575,833 | 3/1986 | Bakhtiari | 368/282 |

FOREIGN PATENT DOCUMENTS

| | | | |
|---|---|---|---|
| 1523841 | 7/1965 | Fed. Rep. of Germany | 368/282 |
| 2837056 | 3/1980 | Fed. Rep. of Germany | 368/281 |
| 158808 | 5/1957 | Sweden | 224/171 |
| 205244 | 8/1939 | Switzerland | 368/281 |

*Primary Examiner*—Vit W. Miska
*Attorney, Agent, or Firm*—Ashen Martin Seldon Lippman & Scillieri

[57] ABSTRACT

A is particularly useful in a specialized activity, such as piloting an airplane, in which a user's forearm is held vertical and with the radial aspect or "edge" of the wrist oriented toward the user's eyes. The mount is for use with a timepiece or other instrument that has a legible face and controls, with the controls preferably above and below the legible face. The mount includes a relatively rigid, standard-size casing that fits loosely on the radial aspect of the wrist, held by a wristband. Along opposite edges of the casing are inward-directed retaining flanges. A relatively compliant insert pad is secured in the casing, between the flanges. The pad is custom fitted, and preferably individually custom-molded, to conform closely to the radial aspect of a particular individual user's wrist. The casing carries the timepiece or other device on the radial aspect of the wrist, with vertical elements of the legible face parallel to the long dimension of the forearm. When the user's forearm is held substantially vertical, the legible face is directed toward the user's eyes and oriented for easiest legibility, and the controls are disposed for easiest manual operation by an opposite hand.

28 Claims, 2 Drawing Sheets

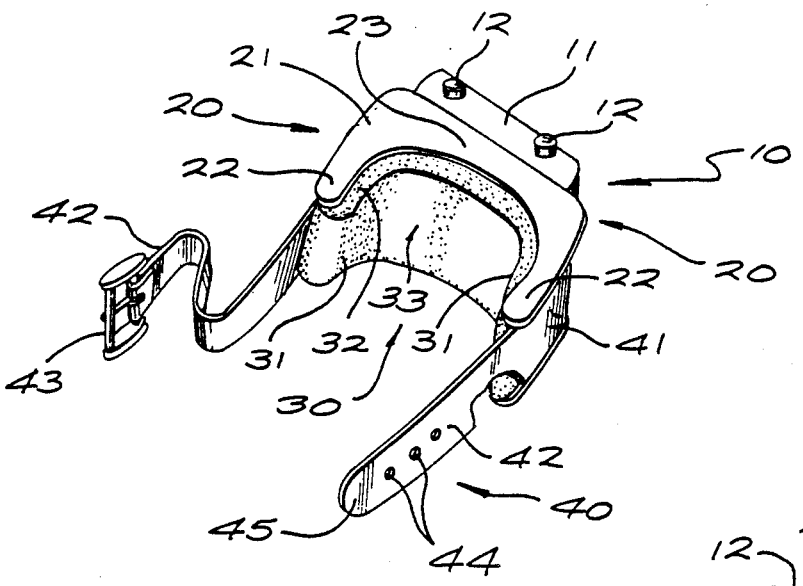
FIG. 1
FIG. 2
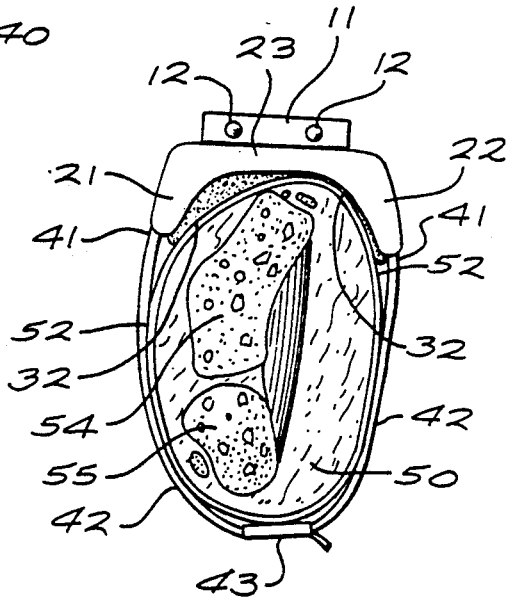
FIG. 3
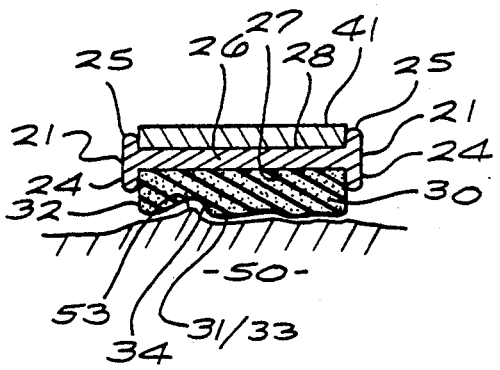
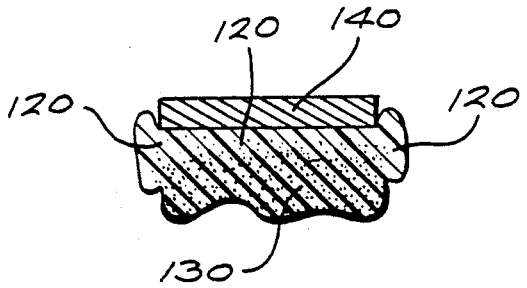
FIG. 5

PILOT'S WRIST MOUNT FOR CARRYING A TIMPEPIECE OR THE LIKE VERTICALLY ON THE RADIAL ASPECT OF THE WRIST

BACKGROUND

1. Field of the Invention

This invention relates generally to wrist mounts for timepieces and the like; and more particularly to an orthotic mount for use by pilots and others, in activities that entail orientation of the forearm vertically with the radial aspect of the wrist directed toward the eyes.

2. Prior Art

Many patents have pointed out that the flat sides of the wrist are troublesome places for mounting wristwatches. When carried on the flat parts of the wrist, timepieces are exposed for breakage—and disposed awkwardly for viewing, even by users in general.

The latter problem is particularly acute, however, for airplane pilots. In operation of a plane, the pilot's forearm is generally held vertical, with the radial aspect or nearer "edge" of the wrist directed toward the pilot's eyes. To permit reading of a watch that is carried on the flat side of the wrist, the arm must almost always be rotated.

Such rotation is not only about the long axis of the arm. Watches are generally oriented for ease of reading while the forearm is disposed transversely across the user's field of view. Thus twisting of the pilot's head or outward swinging of the elbow is required to mutually align the watch face and the field of vision. This viewing awkwardness is compounded by the fact that rotation of the forearm tends to loosen or perturb the pilot's grip on the steering mechanism.

Also difficult to read, because of vibration and changing orientation of the entire airplane, is a timepiece mounted to the control console. In precisely this special context of aircraft operation, however, the exact time must always be available for calculations required in navigation and in traffic-control maneuvers.

Hence in the airplane-piloting context the difficulty of using a wristwatch is aggravated, while the desirability of doing so is enhanced.

Among prior patents that have proposed to alleviate the general wristwatch-mounting problem by securing watches on the edge of the wrist are U.S. Pat. Nos. 3,375,958 to Cooper, 2,187,205 to Katz, 2,226,138 to Prestinari, and 4,575,833 to Bakhtiari. Some of these will be discussed in greater detail shortly, and as will be seen they are not adequate to solve the problem for pilots.

Patents disclosing the possibility of orienting the vertical elements of the watch face parallel to the long dimension of the forearm include the Bakhtiari patent just mentioned, and also U.S. Pat. Nos. 2,562,607 to Ford, 1,874,984 to Hanskat, 1,260,278 to Smith, and 804,493 of McCarthy.

Of these, only Smith shows orientation of the watch with the stem projecting parallel to the long dimension of the forearm. Even this showing appears, however, to be due only to the peculiar coincidence that this early-1900s patent merely provides a wrist-wear adapter for a pocket watch—and the pocket-watch stem of course issues from the part of the case above the "12" on the dial.

In fact, Smith somewhat apologizes for, and even teaches away from, this orientation. He provides a slotted opening in his wrist adapter, for rotating the watch about the operating axis of its works. Smith explains:

> "This construction enables the user to so position the watch that the stem thereof, instead of projecting at right angles from the strap, as indicated in FIG. 1 of the drawings, will lie parallel with and above the strap [to] facilitate the winding of the watch."

Hence Smith teaches that for ease of manual operation the watch stem should issue from the case along the line of the wrist strap.

The McCarthy invention, a motorman's watch carrier, is of interest in that it illustrates how bodily stances taken in operation of some earlier kinds of transportation equipment were more accommodating of the usual orientation of a watch to a wrist. Another patent of interest is U.S. Pat. No. 1,098,369 to De Witt, showing a watch aligned at roughly forty-five degrees to the forearm axis.

These prior wrist-mount configurations that teach radial-aspect mounting actually do little more than attempt to accommodate the size of the radial aspect of the wrist. They fail to accommodate its external shape common to people in general, and the variations in such shape among individuals; and even more to accommodate the internal specific anatomy of particular wearers. All these failings undoubtedly account for the failure of these mounts to appear or at least to persist in the marketplace.

First as to external shape, the wrist joint has certain outward projections from its several small structural elements—the eight small carpal bones that form the working parts of the wrist joint itself. Therefore the radial aspect of the wrist joint is not merely thin, but also very convoluted in shape.

Furthermore, in operation of the wrist for normal functions these outward projections undergo complicated shifts of dimension and relative position. Hence "the" shape which prior mounts fail to accommodate is actually not a single shape at all, but rather a dynamically changing three-dimensional complex.

Thus earlier efforts toward size accommodation were somewhat marginal. The best of these appears to be represented by the Cooper patent mentioned above.

Cooper teaches use of a sheet-metal adapter that fits between the wrist and the watch. Part of this adapter can be bent to follow the overall gross contour of the radial aspect, and the metal holds the shape to which it is bent.

As will be apparent, such a hard, sturdy adapter is desirable to provide a stable platform for the watch—but is only to a very limited extent able to accommodate the various small bony projections of the wrist. It is almost entirely inadequate to accommodate complex motion of those projections.

Cooper's adapter will be realtively uncomfortable and annoying in use, particularly in protracted use that involves active manual operation of equipment such as the controls of an aircraft. Other patents teaching radial-aspect mounting are even less helpful.

Katz and Bakhtiari, for example, do not go as far as Cooper in accommodating the complicated shapes and motions of the wrist. They merely provide relatively narrow case structures and thus are rather primitive in addressing the real physical problem involved. For example, Katz proposes > "By having a watch curved to fit the side of the wrist and of such curvature that it would not fit the top and bottom of the wrist, the watch will stay on the side of the wrist."

Prestinari analogously gives his entire wristwatch case a hooked shape, to lock it into place over one ridge of the radius. He makes no effort to deal with the complexity of fit to the wrist.

In fact, although both Katz and Prestinari describe their inventions as "wrist" mounts, they perhaps more forthrightly illustrate their inventions being worn on a relatively featureless portion of the arm—well away from the actual joint of the wrist. Such locations, often covered by clothing, are of course a poor compromise.

The foregoing comments on failure of prior inventions to accommodate external wrist shape apply to people generally; when individual variations are taken into account, as can now be appreciated, these problems are compounded severely. Some of the inventions described above may be suited to people in an average range of external wrist configurations, particularly when wrist manipulations are very simple; but for people whose wrists are not in such an average range, the prior work in this field is particularly inadequate.

I shall turn now to the problems of accommodating elements of specific anatomy. By this I mean bodily features that are out of sight within the wrist, but familiar to physicians and particularly surgeons.

The wrist has bony prominences which often cause pain when the forearm and wrist are enclosed in a cast; modernly efforts are made to design casts to remove or redistribute pressure away from these prominences. Between two bony prominences, in a fibrous tunnel, is an extensor tendon to the thumb. When that tendon is irritated, a troublesome malady known as "De Quervain's syndrome" arises. Also extending within the wrist is a nerve known as the "radial nerve," which can cause a painful neuroma if rubbed.

Such considerations typically may be negligible to most people in the great majority of occupations. Most activities involve only occasional reference to a wristwatch and impose little in the way of constraints on the orientation and use of the wrist.

These considerations, however, become extremely important for special activities such as piloting an aircraft. In such activities, detailed and accurate checking of the time must sometimes be performed at quite frequent intervals, and constantly maintaining proper grip on control mechanisms for very protracted periods can be crucial to safe operation of the craft.

In summary, prior artisans have perennially addressed the commonly recognized problems of readability, comfort, convenience and safety in wristwatch mounting for use in ordinary activities. None, however, has adequately resolved those problems.

As to wristwatch mounting for special activities such as piloting of airplanes, prior efforts are not even close to an adequate solution. In precisely these special contexts, however, correct time must always be available at a moment's notice for proper, safe performance of the special activity itself.

Certain other prior information may be relevant to my present invention. To the best of my knowledge no connection has previously been suggested between this additional information and the above-described problems of wristwatch mounting on the edge of the wrist, or the problems of aircraft pilots in reading watches. This additional information is drawn from two areas.

First, at least two prior patents teach provision of a resilient pad applied under an otherwise conventional wristwatch. These are U.S. Pat. Nos. 2,562,607 to Ford (mentioned above) and 3,149,452 to Smith.

The Ford patent shows a pad that is captured within a downward-facing cavity in the underside of the watch case; Ford does not indicate or illustrate the part of the wrist on which he intends his invention to be worn. Smith shows his invention worn on the flat of the wrist.

The second area of relevant information is not related to wristwatches at all. It certainly has not been suggested for use in addressing the problems discussed above.

This second area is the modern medical field of orthopedics. In this field it is known to fabricate a splint or "orthosis" in two separate pieces.

One of the pieces is an external casing, typically constructed in perhaps a half-dozen different standard sizes. The other piece is a resilient pad, custom-molded to fit the anatomy of the individual user, and to fit within the appropriate standard-size casing. Naturally the resilience of the pad is selected to suit the therapeutic circumstances involved.

As already mentioned, neither of these two types of prior information has been applied to the above-discussed problems of aircraft pilots. Neither has been used to particularly aid pilots or others in special activities requiring quick, easy access to wristwatches and like instruments.

SUMMARY OF THE DISCLOSURE

My invention is a wrist mount for a timepiece or the like. It is useful for essentially any small instrument to which quick visual reference is desired on a momentary basis at the user's discretion. It is particularly useful in a specialized activity in which a user's forearm is held with the radial aspect of the wrist oriented toward the user's eyes.

In one preferred embodiment, the invention includes a casing that fits loosely upon the radial aspect of a human wrist, and has inward-directed retaining flanges along two opposed edges. This embodiment also has an insert pad, disposed and retained within the casing and between the retaining flanges.

In another preferred embodiment, the invention includes a relatively rigid member that fits loosely upon the radial aspect of a human wrist. This embodiment also has a relatively compliant insert pad, secured between the casing and the wrist.

In both of these embodiments, the pad substantially conforms to the radial aspect of the wrist, and a wristband or equivalent is also included for securing the casing or rigid member of the wrist.

The foregoing may be a discussion of my invention in its broadest or most general form. I prefer, however, to practice the invention with certain other features or characteristics, for a fuller enjoyment of all the benefits of my invention.

For example, the two preferred embodiments just described are not mutually exclusive. Some or all of their features can be combined, and in fact I prefer to combine then to provide a relatively rigid casing with inward-directed flanges, and a relatively compliant insert pad.

I also prefer to make the casing or rigid member a standard size, but to custom-make the pad to fit the radial aspect of an individual user's wrist. Preferably the pad is actually molded to the radial aspect of the individual user's wrist.

In other words, I prefer to make a casting of the wrist of the individual pilot or other person who will use one of these wrist mounts. The casting is then used to form the pad for use on that individual person's wrist.

The casing or rigid member, however, can be selected from a relatively limited number of standard sizes. Generally six to eight standard sizes will provide for fitting the wrists of nearly all adults—perhaps ninety-five or ninty-eight percent of the population.

Because the pad conforms accurately to details of the user's wrist structure, it will also accommodate considerable motion of the wrist joint, provided that the pad is made slightly compliant or resilient.

The amount of resilience needed or desired will vary with the individual wearer. Different amounts of external wrist motion occur in different individuals.

People who prefer to wear the mount off of the wrist joint itself may of course prefer particularly little resilience in the pad. Others who prefer to wear the mount more directly upon part of the ossa carpi or wrist bones, and whose wrists manifest large amounts of external motion, will prefer maximum resilience.

To obtain completely satisfactory fit, both the user's individual preferences and the amount of external motion in the user's individual wrist should be noted at the time a casting is made for the pad. Suitably trained personnel should be provided for this purpose.

Such training is generally comparable to that required for proper individual fitting of eyeglass frames. Training should preferably include imparting a familiarity with not only the external shape of the individual wearer's wrist, but also the issues of "specific anatomy" mentioned in an earlier section of this document—particularly techniques for estimating and accommodating the positions of the extensor tendon and the radial nerve.

Such accommodations may, for example, be made by applying adhesive shims to particular features of the wrist before making the casting. If preferred, similar results can be achieved by later trimming the casting or the finished pad.

I anticipate that when my invention is placed into use with a large number of wearers, still further potential areas of discomfort or disfunction may come to the attention of professionals monitoring the program. It is in the nature of my invention that additional refinements can be straightforwardly incorporated into the formation of each individual pad—or other features of the orthotic mount—to ameliorate such additional problems as well as those already known.

Such further refinements of form to accommodate more-subtle problems which will manifest themselves (and which are now masked by the more-gross inadequacies of prior devices as discussed above) thus are within the scope of my invention as defined in the appended claims.

I also prefer to make my wrist mount particularly for use in a specialized activity in which a user's forearm is held substantially vertical. Here I assume that the timepiece or other instrument has some type of legible face, in which there are vertical elements. By "vertical elements" I mean features that are most easily read when held vertical.

In this regard the casing or rigid member includes some means for holding the instrument so that the vertical elements of its legible face are substantially parallel to the long dimension of the forearm. For purposes of generality in expression of my invention I shall refer to these means as the "holding means." By virtue of the provision of these holding means, the face is oriented for easiest legibility when the user's forearm is held substantially vertical.

A timepiece or other like instrument generally has controls for manual operation. I prefer that such controls be carried on the instrument above or below the face—or both above and below the face. As a result the holding means hold the timepiece or the like with the controls disposed for easiest manual operation by an opposite hand when the forearm carrying the timepiece is held substantially vertical.

It is also my preference to make the casing or rigid member of a reinforced composite material. It can thereby be made extremely light in construction and in weight, so as to be entirely comfortable for the user.

The foregoing operational principles and advantages of the present invention will be more fully appreciated upon consideration of the following detailed description, with reference to the appended drawings, of which:

BRIEF DESCRIPTION OF THE DRAWINGS

FIG. 1 is a perspective view of a preferred embodiment of the invention, a small portion of the wristband being drawn broken away for a clearer view of one end of the casing.

FIG. 2 is an top-end view of the FIG. 1 embodiment superimposed upon a cross section of the human forearm in the area of the wrist joint.

FIG. 3 is a longitudinal section (that is, a section taken parallel to the long dimension of the forearm) of the casing portion of the same embodiment. This view is taken at a point near an end of the casing where the timepiece is not present, and so shows instead only the wristband.

FIG. 5 is a cross-sectional view of another embodiment of my invention, employing graded resilience.

DETAILED DESCRIPTION OF THE PREFERRED EMBODIMENTS

Figure 4:
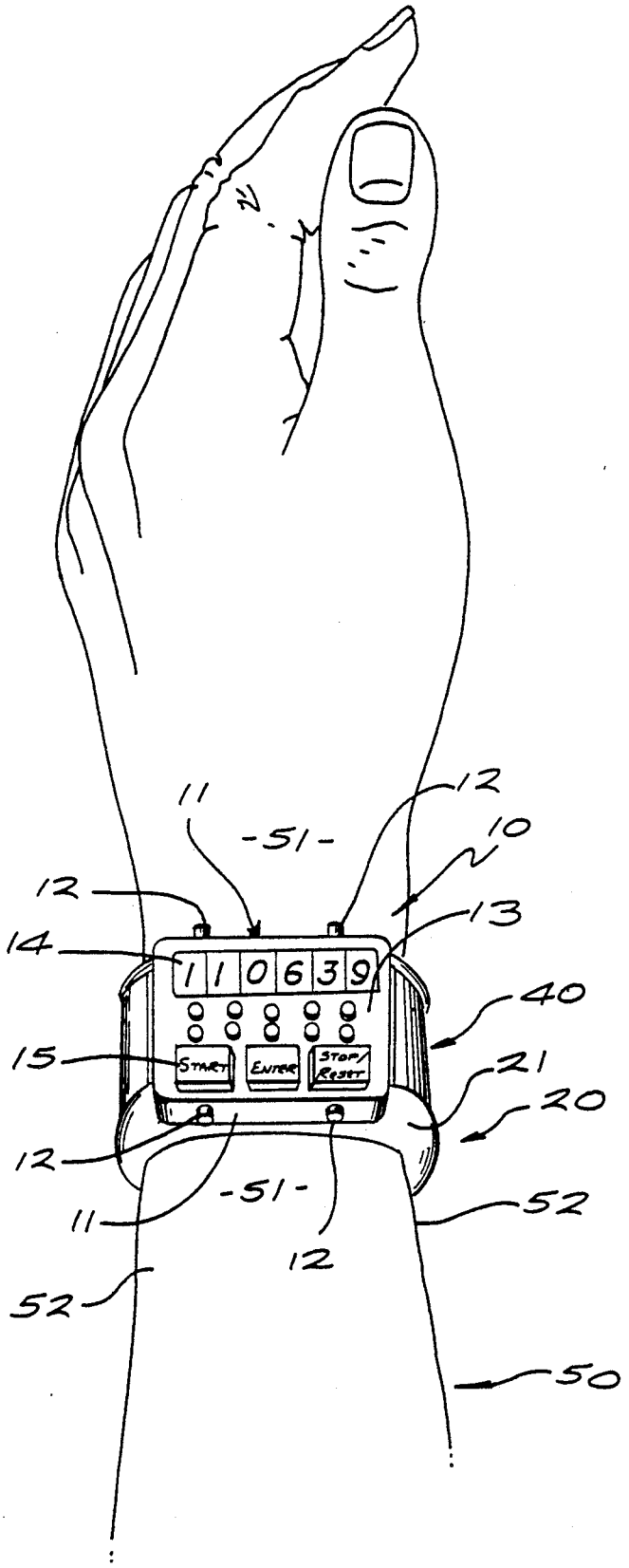
FIG. 4 is a perspective view of the same embodiment in place on a user's arm.

As shown in FIGS. 1, 2 and 4, the invention is for use with a timepiece or like instrument 10. For some purposes I consider the instrument part of the environment or context of my invention; for other purposes as expressed in the appended claims it forms part of the invention itself.

The instrument 10 has a housing with top and bottom end walls 11 carrying controls such as pushbuttons 12. The instrument 10 also has a legible face 13 having various indicia to be read by a user.

In particular such indicia typically include both changeable indicia 14 for indicating the time of day or other variables of interest, and permanent indicia 15 which may for example be function-indicating markings on additional control pushbuttons mounted on the instrument face 13. All of these indicia characteristically have vertical elements—such as the vertical strokes of numerals "1" and "4"—and other like characteristics by which they are recognized and read.

As shown, the instrument 10 is oriented on the radial aspect of the user's forearm, the portion lying above the radius or more-forward large bone 54 within the arm.

(In medicine the radial aspect is sometimes considered the "outer" edge of the arm; however, when a person holds the forearm erect in the characteristic position used for piloting an aircraft or the like, the radial aspect is directed toward the person's eyes and may be more readily identified as the "near" edge.)

In the orientation produced by my invention, the control buttons 12 protrude from the end walls 11 along a direction parallel to the long dimension of the forearm. In this orientation, the vertical elements of the indicia are parallel to the same long dimension, and the face 13 is directed toward the user's eyes.

By virtue of this orientation, when the forearm is held substantially vertical two desirable conditions are satisfied: the control buttons 12 on the end walls 11 are most easily operated by the user's opposite hand, and the indicia are directly and most easily legible. Thus the instrument is fully operable and usable without any turning or twisting of the user's head or watch-carrying arm.

The watch or other instrument 10 is carried on the outside of a relatively rigid casing 20, which has end walls 21. The central portion of the casing 20, and particularly the central portions 23 of the end walls 21, will be spaced outwardly from the radial aspect 51 of the wearer's wrist. The end-wall extrema 22, extending in both directions from the central portions 23, curve around the wearer's wrist toward the flat sides 52 of the wrist.

As particularly shown in FIG. 3, however, no part of the rigid casing 20 contacts the user's wrist 50. Rather the casing 20 is spaced away from the wrist 50 by the relatively resilient insert pad 30.

The pad too has end faces 32, directed parallel to the long dimension of the forearm. The pad 30 also has a central section 33 adjacent to the radial surface 51 of the user's arm 50, and has two ends 31 that curve around the wearer's wrist toward the flat sides 52 of the wrist.

Unlike the casing, however, the pad 30 is directly in contact with the user's arm. Specifically, the central section 33 makes direct contact with the radial surface 51 of the wrist 50, and the ends 31 make direct contact with the flat sides 52.

As particularly shown in FIG. 3, the pad 30 has internal features 34 custom-molded to complement the detailed structural features 53 of the user's arm 50—as previously explained, the outward projections of the carpal bones. Because the pad 30 is resilient, it comfortably accommodates considerable shifting and twisting of such structural features 53 in normal use of the arm 50.

FIG. 3 also shows that the casing 20 preferably has inward-directed flanges or lips 24 along both edges. These flanges 24 help to retain the pad 30 securely in its proper place between the casing 20 and arm 50; however, if preferred the pad can be secured to the casing by other means such as adhesive, snaps, etc., and the flanges 24 omitted.

To similarly retain the wristband 40, the casing preferably also has flanges 25 directed outward. The band 40 preferably attaches to the instrument 10 or the casing 20, or both, and encircles the ulna 55 (the long bone that extends along the "far edge" of the forearm—see FIG. 2) and the flat sides of the user's wrist.

The band 40 may characteristically have portions 41 that ride on the casing 20, other portions 42 that extend along the flat sides of the wrist in both directions from the casing 20, and a suitable fastening such as a buckle 43 at one tip, and spaced holes 44 near the other tip 45. Alternatively an expansion band may be provided.

My invention permits wearing of a wristwatch or the like on the radial aspect of the wrist joint itself, directly upon the *ossa carpi*, if the user so desires. If preferred the user may instead elect to have the mount prepared for use on a portion of the forearm that is partially on and partially off the joint, or spaced well away from it—all at the user's discretion.

For many users, depending upon the details of the anatomy in the region of the wrist, it will be feasible to have more than one insert pad 30 made for a single casing 20. Doing so will allow the user to wear the instrument 10 sometimes directly on the wrist joint and sometimes elsewhere. As will be appreciated the incremental cost of making two molds instead of only one, upon the occasion of a user's visit for a wrist-mount fitting, is very modest.

If preferred, the compliant or resilient pad and more-rigid casing can be formed together as a unitary article of graded resilience. Thus the casing can be formed as a sort of crust 120 (FIG. 5) on outward-facing surfaces of the article; while the pad 130 is formed in the same article as a softer portion, facing inward toward the wrist. (The drawing may also be taken as illustrating a lamination.)

Such constructions can be prepared by, for example, applying heat, ultraviolet light, or some other form of radiation or condition selectively to one or the other portion, depending on the effect of the employed radiation or condition upon the curing of the particular material selected for use. Alternatively, the chemical constituency of the material can be varied across the thickness of the structure; or both these techniques can be combined—all in ways familiar to those skilled in the art of forming elastomers.

Figure 6:
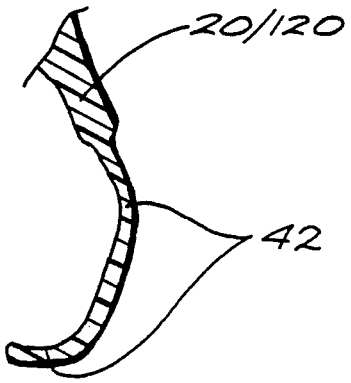
FIG. 6 is a fragmentary longitudinal section of a variant of my invention in which the casing and band are unitary.

As shown in FIG. 6, the wrist band 42 can be made part of the casting 20 or 120.

The foregoing disclosure is intended to be merely exemplary, not to limit the scope of the invention—which is to be determined by reference to the appended claims.

I claim:

1. A wrist mount, for a timepiece or the like, and particularly useful in a specialized activity in which a user's forearm is held with the radial aspect of the wrist oriented toward the user's eyes; said mount comprising:

a casing that fits loosely upon the radial aspect of a human wrist, generally out of contact with the wrist, and has inward-directed retaining flanges extending from the casing, along two opposed edges thereof, toward the wrist;

a wristband for securing the casing to the wrist; and an insert pad, disposed and retained within the casing and between the retaining flanges, and having a portion extending beyond the flanges toward the wrist so that the pad directly contacts the wrist; said pad defining at least one marked recess or protuberance, or both, that substantially conform to detailed structure of the radial aspect of the wrist such as bony projections therefrom; and said pad spacing the casing away from and generally out of contact with the wrist.

2. The wrist mount of claim 1, wherein:

the casing is substantially rigid; and the pad is sufficiently compliant to accommodate shifts of dimension and relative position of said detailed structure.

3. The wrist mount of claim 1, wherein:
the casing is a standard size; and
the pad is custom-manufactured to fit the radial aspect of the individual wrist.

4. The wrist mount of claim 1, wherein:
the casing is substantially rigid and a standard size; and
the pad is relatively compliant and custom-manufactured to fit the radial aspect of the individual wrist.

5. The wrist mount of claim 1, wherein:
the casing is a standard size; and
the pad is individually custom-molded to the radial aspect of the individual wrist.

6. The wrist mount of claim 1, wherein:
the casing is substantially rigid and a standard size; and
the pad is compliant and individually custom-molded to the radial aspect of the individual wrist.

7. The wrist mount of claim 6, wherein:
said standard size of the casing is one of a limited number of standard sizes.

8. The wrist mount of claim 6, wherein:
the casing is made of a reinforced composite material.

9. The wrist mount of claim 1, for use with such a timepiece or the like that has a legible face, and particularly for use in a specialized activity in which a user's forearm is held substantially vertical; and wherein:
the casing comprises means for holding a timepiece or the like so that vertical elements of the legible face are substantially parallel to the long dimension of the forearm;
wherein the pad and the holding means cooperate to permit comfortable orientation of the face for easiest legibility, with the forearm held substantially vertical, for protracted periods of time while the user continuously engages in said specialized activity.

10. In combination, for use in a specialized activity in which a user's forearm is held substantially vertical and with the radial aspect of the wrist oriented toward the user's eyes:
a wrist mount that comprises:
a casing that fits loosely upon the radial aspect of a human wrist, generally out of contact with the wrist, and has inward-directed retaining flanges extending from the casing, along two opposed edges thereof, toward the wrist,
a wristband for securing the casing to the wrist,
an insert pad, disposed and retained within the casing and between the retaining flanges, and having a portion extending beyond the flanges toward the wrist so that the pad directly contacts the wrist; said pad defining at least one marked recess or protuberance, or both, that substantially conform to detailed structure of the radial aspect of the wrist such as bony projections therefrom; and spaces the casing away from and generally out of contact with the wrist; and in combination therewith
supported from the casing of the wrist mount, a timepiece or the like that has a legible face;
wherein the casing comprises means for holding the timepiece or the like so that vertical elements of the legible face are substantially parallel to the long dimension of the forearm;
whereby the face is oriented for easiest legibility when the forearm is held substantially vertical.

11. The combination of claim 10, wherein:
the timepiece or the like has controls for manual operation; and
the controls are carried on the timepiece or the like above or below the face, or both above and below the face;
wherein the pad and the holding means cooperate to hold the timepiece or the like comfortably, for protracted periods of time, with the controls disposed for easiest manual operation by an opposite hand while the user engages in such specialized activity, with the forearm held substantially vertical.

12. A wrist mount, for a timepiece or the like, and particularly for use in a specialized activity in which a user's forearm is held with the radial aspect of the wrist oriented toward the user's eyes; said mount comprising:
a relatively rigid member that fits loosely upon the radial aspect of a human wrist, generally out of contact with the wrist;
a wristband for securing the rigid member to the wrist; and
a relatively compliant insert pad, secured between the relatively rigid member and the radial aspect of the wrist; and wherein said pad;
(a) has a portion that extends inward beyond an innermost part of the rigid member toward the radial aspect of the wrist, to directly contact the radial aspect of the wrist,
(b) spaces the rigid member away from and generally out of contact with the wrist,
(c) defines at least one marked recess or protuberance, or both, that directly engage and substantially conform to detailed structure of the radial aspect of the wrist, particularly including the carpal bones within and projecting from the radial aspect, and
(d) is sufficiently compliant to comfortably accommodate shifts of dimension and relative position of said carpal bones, while directly engaged therewith during such specialized activity.

13. The wrist mount of claim 12, wherein:
the relatively rigid member is a standard size; and
the pad is custom-made to fit the radial aspect of the individual wrist.

14. The wrist mount of claim 12, wherein:
the relatively rigid member is a standard size; and
the pad is individually custom-molded to the radial aspect of the individual wrist.

15. The wrist mount of claim 12, for use with such a timepiece or the like that has a legible face, and particularly for use in a specialized activity in which a user's forearm is held substantially vertical; and wherein:
the relatively rigid member comprises means for holding a timepiece or the like so that vertical elements of the legible face are substantially parallel to the long dimension of the forearm;
wherein the pad and the holding means cooperate to permit comfortable orientation of the face for easiest legibility, with the forearm held substantially vertical, for protracted periods of time while the user continuously engages in said specialized activity.

16. The wrist mount of claim 12, further comprising:
means for securing such a timepiece or the like to the rigid member, out of contact with the pad.

17. The wrist mount of claim 12, further comprising:

means for securing such a timepiece or the like on an outward-facing surface of the rigid member, out of contact with the pad.

18. The wrist mount of claim 12, wherein:

the relatively rigid member and the relatively compliant pad are both provided together in the form of a lamination having plural layers of material of respectively different resiliences, each layer being extended from the radial aspect to both flat sides of the wrist, and each layer ranging from high resilience of at least one lamina that contacts the wrist to low resilience of at least one lamina that does not contact the wrist.

19. the wrist mount of claim 18, wherein:

the wrist band is provided as one lamina of the lamination.

20. In combination, particularly for use in a specialized activity in which a user's forearm is held substantially vertical and with the radial aspect of the wrist oriented toward the user's eyes:

a wrist mount, comprising:

a relatively rigid member that fits loosely upon the radial aspect of a human wrist, generally out of contact with the wrist, a wristband for securing the rigid member to the wrist, and a relatively compliant insert pad, secured between the relatively rigid member and the wrist, and having a portion extending from the rigid member toward the wrist so that the pad directly contacts the wrist; said pad defining at least one marked recess or protuberance, or both, that substantially conform to detailed structure of the radial aspect of the wrist such as bony projections therefrom; and said pad spacing the rigid member away from and generally out of contact with the wrist; in combination with supported from the wrist mount, a timepiece or the like that has a legible face;

wherein the relatively rigid member comprises means for holding a timepiece or the like so that vertical elements of the legible face are substantially parallel to the long dimension of the forearm;

whereby the face is oriented for easiest legibility when the forearm is held substantially vertical.

21. The combination of claim 20, wherein:

the timepiece or the like has controls for manual operation; and the controls are carried on the timepiece or the like above or below the face, or both above and below the face;

wherein the holding means cooperate to hold the timepiece or the like comfortably for protracted periods of time with the controls disposed for easiest manual operation by an opposite hand when the forearm is held substantially vertical.

22. A wrist mount, for a timepiece or the like, and particularly for use in a specialized activity in which a user's forearm is held with the radial aspect of the wrist oriented toward the user's eyes; said mount comprising:

a relatively rigid member that fits loosely upon the radial aspect of a human wrist;

a wristband for securing the rigid member to the wrist; and a relatively compliant insert pad, secured between the relatively rigid member and the wrist, that substantially conforms to the radial aspect of the wrist;

wherein the relatively rigid member and the relatively compliant pad are both provided together in the form of a substantially unitary casting having graded resilience, ranging from high resilience in a region that contacts the wrist to low resilience in a region that does not contact the wrist.

23. The wrist mount of claim 22, wherein:

the wrist band is also part of the unitary casting.

24. A wrist mount, for a timepiece or the like, and particularly for use in a specialized activity in which a user's forearm is held with the radial aspect of the wrist oriented toward the user's eyes; said mount comprising:

a substantially unitary, integral member having graded resilience, ranging:

from a portion of relatively higher resilience, which when in use contacts and substantially conforms to the radial aspect of a human wrist, to a portion of relatively higher rigidity, which when in use retains the higher-resilience portion in position on the radial aspect of the wrist; and a wristband for securing the unitary, integral member to the wrist.

25. A wrist mount, for a timepiece or the like having a legible face and controls mounted above or below the face, or both above and below the face; said mount being particularly for use in a specialized activity in which a user's forearm is held substantially vertical with the radial aspect of the wrist oriented toward the user's eyes; said mount comprising:

a relatively rigid standard-size casing that fits loosely upon the radial aspect of a human wrist, generally out of contact with the wrist, and has inward-directed retaining flanges extending from the casing, along two opposed edges thereof, toward the wrist;

a wristband for securing the casing to the wrist; and a relatively compliant insert pad, disposed and retained within the casing and between the retaining flanges, and having a portion extending beyond the flanges toward the wrist so that the pad directly contacts the wrist; and said pad being individually custom-molded to define at least one marked recess or protuberance, or both, that substantially conform to detailed structure of the radial aspect of an individual user's wrist such as bony projections thereform; and said pad spacing the casing away from and generally out of contact with the wrist;

means for holding a timepiece or the like to the casing upon the radial aspect of the wrist so that vertical elements of the legible face are substantially parallel to the long dimension of the forearm, and so that when the user's forearm is held substantially vertical the controls are disposed vertically with respect to said legible face;

wherein the pad and the holding means cooperate to permit the timepiece to be carried comfortably for protracted periods of time upon the radial aspect of the wrist, with the forearm is held substantially vertical, said legible face is directed toward the user's eyes and oriented for easiest legibility, and the controls are disposed for easiest manual operation by an opposite hand.

26. In combination, particularly for use in a specialized activity in which a user's forearm is held substantially vertical with the radial aspect of the wrist oriented toward the user's eyes:

a wrist mount, comprising:

a relatively rigid standard-size casing that fits loosely upon the radial aspect of a human wrist, generally out of contact with the wrist, and has inward-directed retaining flanges extending from the casing, along two opposed edges thereof, toward the wrist, a wristband for securing the casing to the wrist, a relatively compliant insert pad, disposed and retained within the casing and between the retaining flanges, and having a portion extending beyond the flanges toward the wrist so that the pad directly contacts the wrist; and said pad being individually custom-molded to define at least one marked recess or protuberance, or both, that substantially conform to detailed structure of the radial aspect of an individual user's wrist, and means for holding a timepiece or the like to the casing upon the radial aspect of the wrist so that vertical elements of the legible face are substantially parallel to the long dimension of the forearm, and so that when the user's forearm is held substantially vertical the controls are disposed vertically with respect to said legible face; in combination with a timepiece or the like, held by the holding means, and having a legible face and controls mounted above or below the face, or both above and below the face;

whereby the timepiece is carried upon the radial aspect of the wrist; and, when the forearm is held substantially vertical, said legible face is directed toward the user's eyes and oriented for easiest legibility, and the controls are disposed for easiest manual operation by an opposite hand.

27. A method for making a wrist mount for a timepiece or like instrument for a particular wearer, comprising the steps of:

identifying such a particular wearer;

then making a mold of the radial aspect of the particular wearer's wrist;

then using the mold to cast a custom-fitting resilient pad to the particular wearer's wrist, said pad defining at least one marked recess or protuberance, or both, that substantially conform to detailed structure of the radial aspect of the particular wearer's wrist;

providing an outer casing that is one of a very limited number of standard sizes, and that has a cavity therein for receiving a portion of the pad and has mounting features for holding the timepiece or like instrument;

disposing said portion of the resilient pad in the cavity of the outer casing, with another portion of the pad extending beyond the exterior of the casing toward and into contact with the wrist;

said mold-using step comprising sizing the pad to space the casing generally out of contact with the wearer's wrist.

28. A method for making a wrist mount for a timepiece or like instrument for a particular wearer, comprising the steps of:

making a mold of the radial aspect of the particular wearer's wrist;

then using the mold to cast a custom-fitting resilient pad to the particular wearer's wrist;

disposing the resilient pad within an outer casing that is one of a very limited number of standard sizes and that has mounting features for holding the timepiece or like instrument;

wherein the disposing step comprises molding said outer casing as a relatively rigid portion integral with the resilient pad.

* * * * *